US007551100B1

(12) United States Patent
Salley et al.

(10) Patent No.: US 7,551,100 B1
(45) Date of Patent: Jun. 23, 2009

(54) CHILD SEAT SIMULATION SYSTEM

(76) Inventors: G. Mackay Salley, 708 Springdale Dr., Spartanburg, SC (US) 29302; Julian E. Hankinson, Jr., 850 Nazareth Church Rd., Spartanburg, SC (US) 29301

( * ) Notice: Subject to any disclaimer, the term of this patent is extended or adjusted under 35 U.S.C. 154(b) by 141 days.

(21) Appl. No.: 11/365,140

(22) Filed: Mar. 1, 2006

(51) Int. Cl.
*G08B 25/00* (2006.01)

(52) U.S. Cl. ..... 340/692; 340/691.1; 340/691.7; 5/108; 5/109

(58) Field of Classification Search ..... 340/692
See application file for complete search history.

(56) References Cited

U.S. PATENT DOCUMENTS

| | | | | |
|---|---|---|---|---|
| 4,655,503 | A | 4/1987 | Kamijo et al. | |
| 4,874,162 | A * | 10/1989 | Trumbull et al. | 472/60 |
| 4,979,777 | A | 12/1990 | Takada | |
| 5,147,109 | A | 9/1992 | Jolly | |
| 5,342,113 | A * | 8/1994 | Wu | 297/260.2 |
| 5,464,381 | A | 11/1995 | Wilson | |
| 5,482,352 | A | 1/1996 | Leal et al. | |
| 5,624,155 | A | 4/1997 | Bluen et al. | |
| 5,624,156 | A * | 4/1997 | Leal et al. | 297/217.4 |
| 5,660,430 | A | 8/1997 | Clarke | |
| 5,660,597 | A | 8/1997 | Fox et al. | |
| 5,733,003 | A | 3/1998 | Goor | |
| 5,810,596 | A * | 9/1998 | Van Lookeren Campagne | 434/62 |
| 6,053,815 | A * | 4/2000 | Hara et al. | 463/46 |
| 6,220,171 | B1 | 4/2001 | Hettema et al. | |
| 6,256,965 | B1 | 7/2001 | Sheridan | |
| 6,299,503 | B1 | 10/2001 | Lagrone | |
| 6,412,867 | B2 | 7/2002 | Robinson | |
| 6,431,646 | B1 * | 8/2002 | Longoria | 297/217.3 |
| 6,473,272 | B1 * | 10/2002 | Resh et al. | 360/266 |
| 6,481,794 | B1 | 11/2002 | Kassai et al. | |
| 6,594,840 | B2 | 7/2003 | Tomas et al. | |
| 6,669,288 | B2 | 12/2003 | Nakagawa et al. | |
| 6,739,649 | B2 | 5/2004 | Kelly et al. | |
| 6,796,610 | B2 | 9/2004 | Nakagawa et al. | |
| 6,811,217 | B2 | 11/2004 | Kane et al. | |
| 7,039,207 | B1 * | 5/2006 | Elrod et al. | 381/301 |
| 2004/0140699 | A1 | 7/2004 | Akpom | |
| 2004/0149497 | A1 * | 8/2004 | Larsen et al. | 177/229 |
| 2005/0189796 | A1 * | 9/2005 | Gregorian | 297/130 |
| 2005/0283908 | A1 * | 12/2005 | Wong et al. | 5/109 |
| 2006/0211506 | A1 * | 9/2006 | Kakuda | 472/118 |

OTHER PUBLICATIONS

Research Disclosure Journal No. 492064 (Crosthwaite et al.), Apr. 2005.*

* cited by examiner

*Primary Examiner*—Toan N Pham
*Assistant Examiner*—Kerri L McNally
(74) *Attorney, Agent, or Firm*—Smith Moore Leatherwood LLP; Thomas W. Epting

(57) ABSTRACT

A system having a support that supports a child seat and a controller that outputs motion, sound, and/or image signals to be experienced by a child in the child. An actuator connected to the support moves the support responsive to the motion signal, and the corresponding sounds and image signal may be synchronized therewith. A recorder may be used to record motions and sounds from an actual vehicle. A method includes providing a support for the child seat, and producing a motion signal substantially corresponding to the motions experienced by the child in the child seat in the vehicle. The method further includes moving the support responsive to the motion signal for simulating the motions experienced by the child in the child seat when in the vehicle.

12 Claims, 11 Drawing Sheets

CHILD SEAT SIMULATION SYSTEM

BACKGROUND OF THE INVENTION

This invention relates generally to a system for simulating motions, sounds and/or visual images for a child in a child seat, and in particular, simulating the motions, sounds and/or visual images to which the child is subjected when carried by the child seat in a vehicle.

Parents and guardians of infants and young children have recognized, that on occasion, a child who may otherwise be agitated, restless, sleepy, or unconsolable, can be calmed down and soothed by placing the child in the child's car, or child, seat within a conveyance, such as the family vehicle, and taken for a drive. It is believed that the vibrations of the vehicle, the sounds heard by the child, such as road noise, engine and transmission noises, etc., may tend to relax and calm the child down. Additionally, the child may be stimulated by visual images which seemingly pass by as the child looks through the windows during movement of the vehicle.

However, placing a child in a child seat and driving the child around in a vehicle can be a time consuming endeavor, and also places wear and tear on the vehicle. Further, given the cost of fuel and the time expended by the driver in driving the vehicle, this child soothing method may become less attractive. Additionally, there are safety concerns in that the risk of the child being involved in a vehicular accident are obviously greater if the child is carried in a vehicle more often than is necessary.

Accordingly, it would be desirable to provide the child with the comforting and soothing motions, sounds, and perhaps visual images typically experienced by the child when riding in his or her child seat in a vehicle, without requiring the child to actually be placed in the vehicle and driven about.

It would further be desirable to be able to simulate such vehicle riding experiences within a safe, controlled, and convenient environment, such as, for example, the child's own home.

It would be still further desirable to provide the child in a child seat with motions, sights, and sounds differing from that typically experienced in a vehicle ride.

SUMMARY OF THE INVENTION

Generally, the present invention includes a system for simulating, remotely from a vehicle, the motions experienced by a child in a child seat in the vehicle. The system includes a support that supports the child seat and a controller, or driver, that outputs a motion signal substantially corresponding to the motions experienced by the child seat in the vehicle. An actuator connected to the support moves the support responsive to the motion signal. Alternately, instead of simulating the motions experienced by the child in a vehicle, the present invention can also be used to offer other simulated motions, sights, and/or sounds unrelated to, or independent of, the vehicle.

More specifically, certain preferred embodiments of the present invention include the support having at least one recess for receiving the child seat and a releasable fastener for attaching the child seat to the support. The amplitude of the actuator can be adjusted, either manually or automatically, depending on the desired range of motion to be imparted to the child.

A recorder can be provided for making a recording of the motions, sounds and/or images generally experienced by the child in the child seat in the vehicle. Preferably, the motion signal output by the driver, which may be a processor, computer, programmable logic controller (PLC) field programmable gate array (FPGA), microprocessor, and/or a suitable amplification circuit, is correlated to the recording of the sounds (audio inputs) and/or images (video inputs). The sounds are output via an acoustic emission device, such as a speaker, in a base unit, and the images are displayed on a display device, such as a liquid crystal display (LCD), plasma display, cathode ray tube (CRT), or some other suitable display device attached to the base unit. A storage device may be used that stores one or more of the recordings (motion, audio, video, etc.) and which provides an output to the driver. Such storage device could be one or more storage media including, but not limited to, a compact disc player, a tape recorder, a digital video disc recorder, an electrically-erasable programmable read-only memory (EEPROM) device, a computer drive, a non-volatile read write memory (NVRWM) device, a memory card, a USB flash drive, etc.

The actuator can be configured to move the support linearly and/or arcuately in three axes and can be one or more suitable motive devices, including, but not limited to, an electric motor, a hydraulic actuator, a pneumatic actuator, a piezoelectric actuator, a servomotor, a linear motor, a stepping motor, a voice coil actuator, an electro-dynamic exciter, a solenoid, etc. Means for dynamically balancing the actuator during operation can also be provided to reduce the transfer of vibration to the surface on which the base unit rests. In one embodiment, a dynamically tuned mass provides a reaction force corresponding to operation of the actuator.

A predetermined sequence of operation can be imparted to the actuator and/or a motion signal provided to operate the actuator. Such synthesized signal can be a combination of one or more signals, such as, but not limited to, a single frequency sine wave signal, a multiple sine wave signal, a random noise signal, a periodic non-sinusoidal wave signal, etc. Such signals could be resident in the processor and/or could be provided from an external source via a signal input to the processor.

Power is preferably supplied to the actuator and driver via a direct current (DC) power source, such as batteries or a battery pack, which is preferably rechargeable with alternating current (AC) power. Alternately, AC power could be used to directly power the actuator, driver, speakers, displays, etc.

The base unit can be used as a recorder of sounds and motions by being placed in a vehicle or other conveyance. An accelerometer can be used to measure the vibrations and displacements from the vehicle, and the speaker can, acting as a microphone, record ambient sounds. The vibrations/displacements can be synchronized with the sounds by the processor.

The present invention also includes a method, generally, for simulating, remotely from a vehicle, the motions experienced by a child in a child seat in the vehicle. The method includes providing a support for the child seat, and producing a motion signal substantially corresponding to the motions experienced by the child in the child seat in the vehicle. The method further includes moving the support responsive to the motion signal for simulating the motions experienced by the child in the child seat in the vehicle.

More specifically, the method may include providing a recorder for making a recording of the motions, sounds, and/or images generally experienced by the child in the child seat in the vehicle and correlating the signal to the recording.

Alternately, the present invention includes a method of simulating motions, sights, and/or sounds for a child in a child seat which are unrelated to, and independent of, a particular vehicle.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

The foregoing, as well as other objects of the present invention, will be further apparent from the following detailed description of the preferred embodiment of the invention, when taken together with the accompanying drawings and the description which follows set forth this invention in its preferred embodiment. However, it is contemplated that persons generally familiar with simulators will be able to apply the novel characteristics of the structures illustrated and described herein in other contexts by modification of certain details. Accordingly, the drawings and description are not to be taken as restrictive on the scope of this invention, but are to be understood as broad and general teachings.

Figure 12:
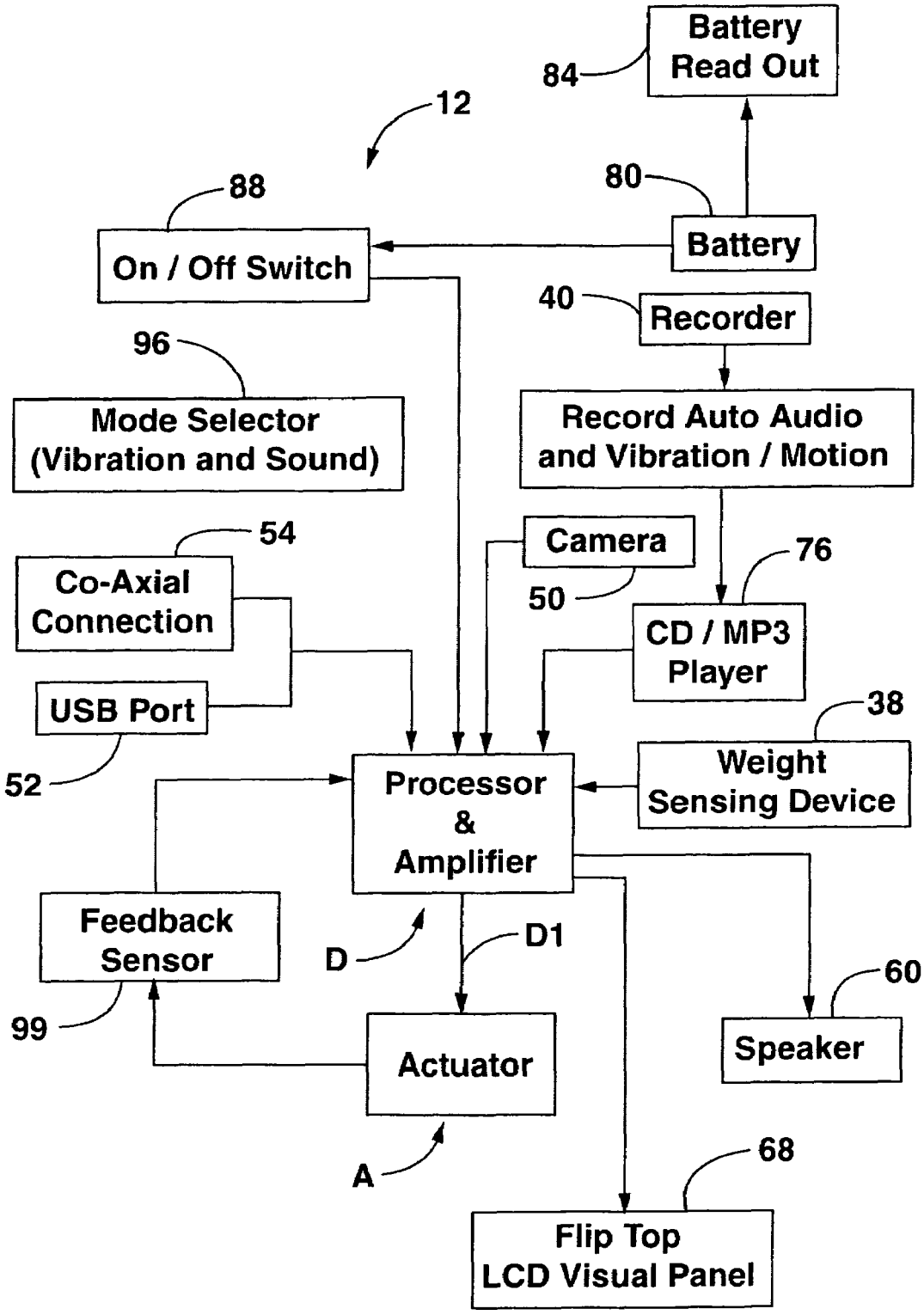
FIG. 12 is a functional diagram of a child seat simulation system constructed in accordance with the present invention.

Referring now to the drawings in detail, wherein like reference characters represent like elements or features throughout the various views, the child seat simulation system of the present invention is indicated generally by reference character 10 in FIG. 12.

Figure 1:
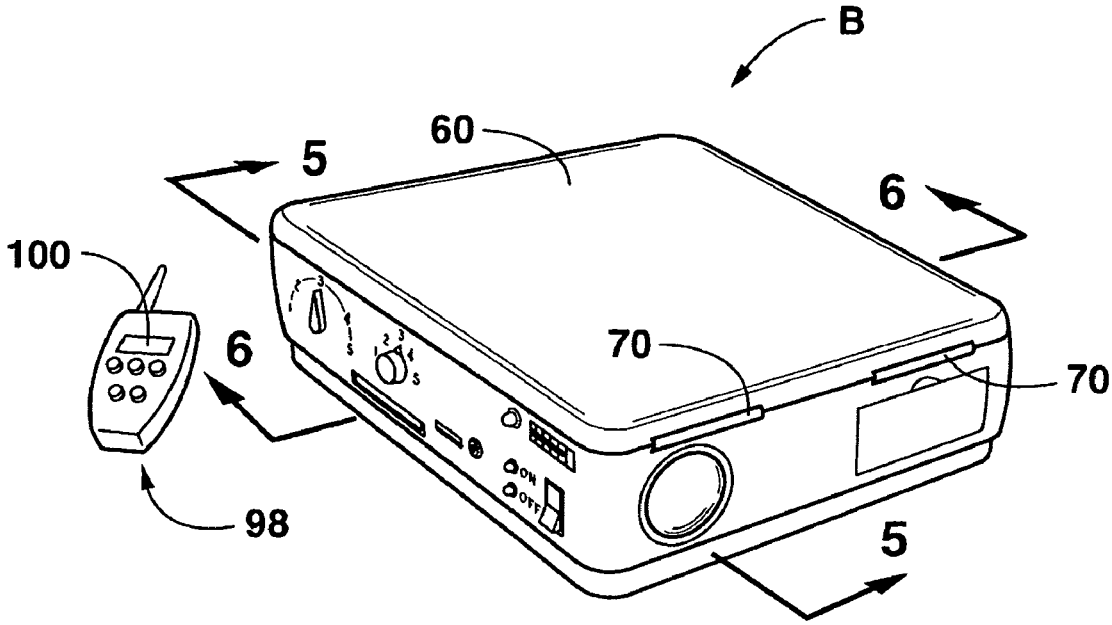
FIG. 1 is a perspective view of a base unit and remote control constructed in accordance with the child seat simulation system of the present invention.
Figure 3:
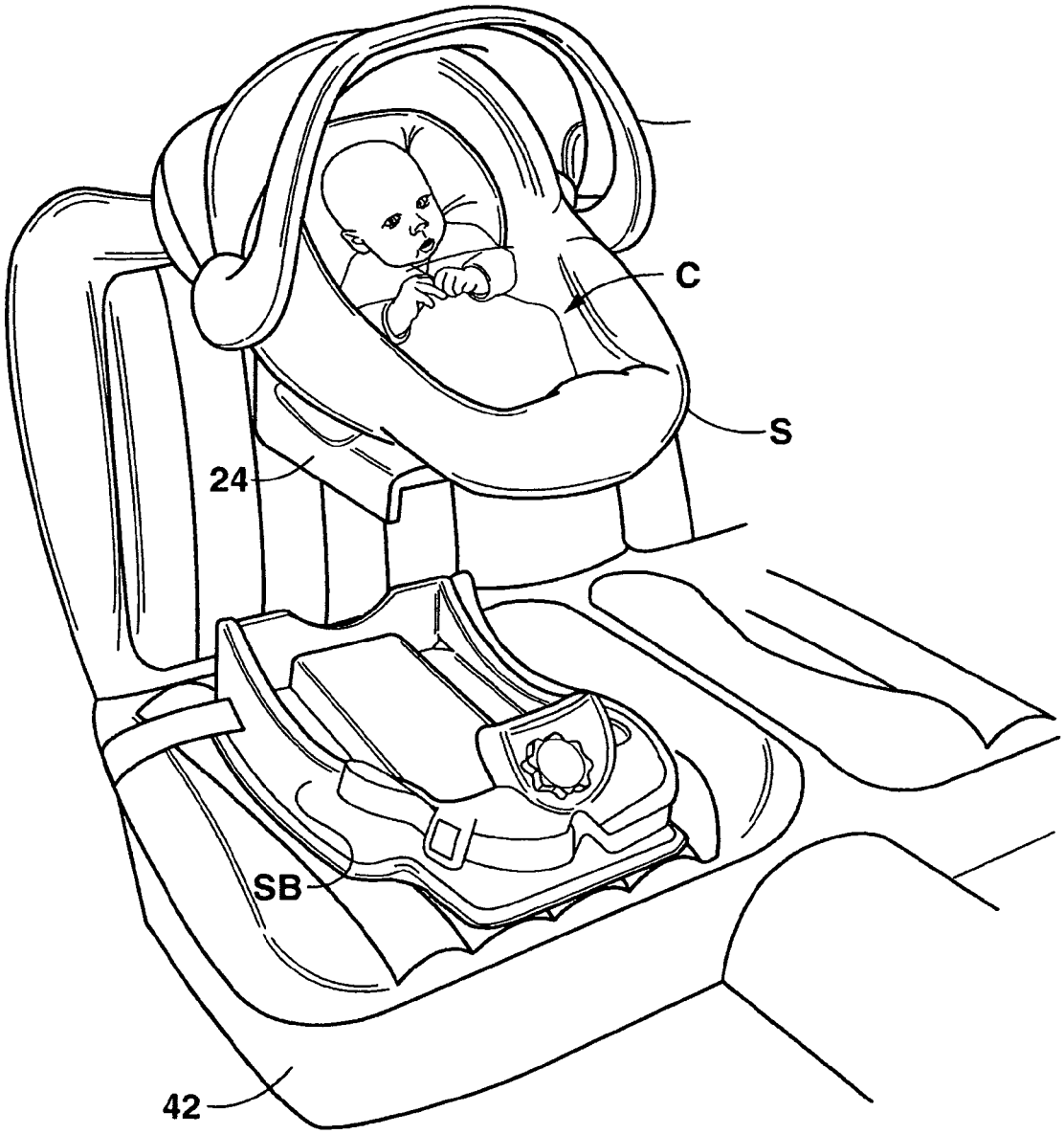
FIG. 3 is a perspective view of a conventional child seat and vehicle base within a vehicle.

Briefly, as shown in FIG. 1, the system of the present invention is for generally simulating the motions experienced by a child, generally C (FIG. 3), carried in a child seat, generally S, such as when the child is transported within a vehicle or other conveyance. As used herein, the terms "vehicle" and "conveyance" include, but are not limited to, an automobile, truck, sport utility vehicle (SUV), van, mini-van, boat, plane, all-terrain vehicle (ATV), motorcycle, bicycle, snow mobile, tractor, wagon, cart, trailer, stroller, child carrier backpack, amusement park ride, or other means of transport or motion development.

Turning to FIG. 1, the child seat simulation system of the present invention is illustrated in one preferred embodiment, as including a base unit, generally B. Base unit B includes a support, generally P (FIG. 2), for supporting child seat S. A driver, or controller, generally D (FIG. 12), which could be a computer, programmable logic controller (PLC), field programmable gate array (FPGA), processor, microprocessor, or other electronic circuit, and which includes an amplifier, outputs to an actuator, generally A, a motion signal, generally D1, corresponding to the motions experienced by child seat S when carried in a vehicle or conveyance. Motion signal D1 could be electronic, optical, and/or acoustic, and in one preferred embodiment, as herein disclosed, is electronic.

Actuator A is connected to support P and moves support P responsive to motion signal D1 (FIG. 12). As noted above, actuator A could be any of a number of motive devices, and includes, but is not limited to, a voice coil actuator, an electric motor, a hydraulic actuator, a pneumatic actuator, a piezoelectric actuator, a servomotor, a linear motor, a stepping motor, an electro-dynamic exciter, etc.

Figure 2:
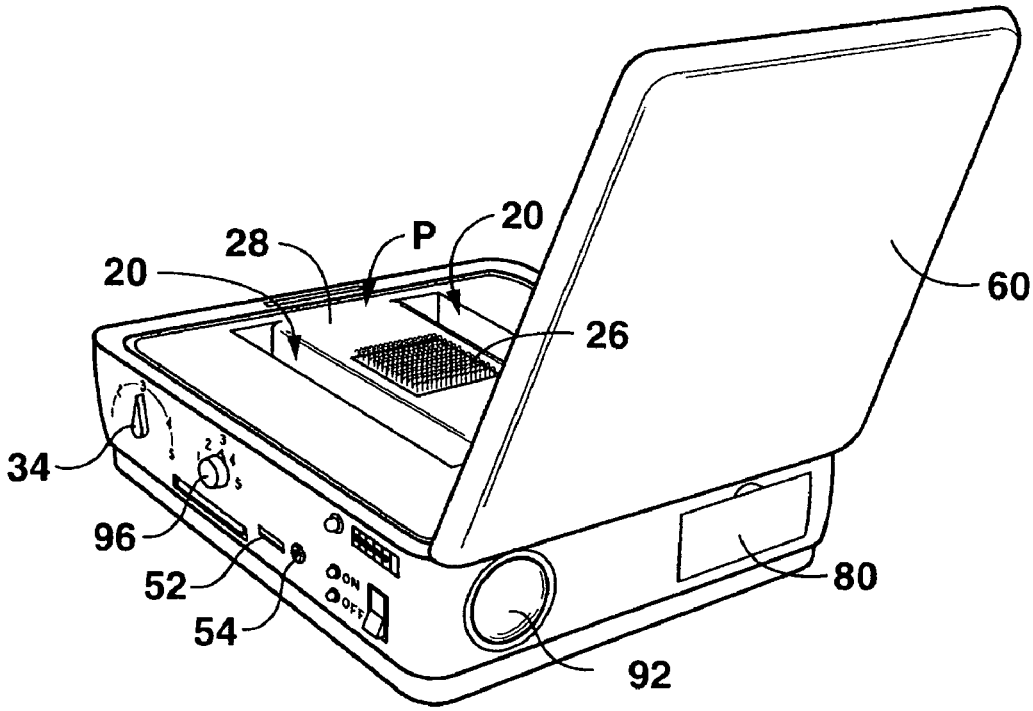
FIG. 2 is a perspective view of the base unit of FIG. 1, having a cover and/or display screen moved to a raised position.

Turning to FIGS. 1 and 2, base unit B includes support P defining recesses 20 for receipt of downwardly extending flanges 24 (FIG. 3) of child seat S. Receipt of flanges 24 in recesses 20 serve to secure seat S within support P, and in particular, serve to restrain movement of seat S side-to-side and fore and aft with respect to base unit B.

Additionally, a releasable fastener, such as a cooperating hook and loop fastener, i.e., such as, but not limited to, Velcro®, 26 is provided on a bridging surface 28 spanning between recesses 20. Fastener 26 would cooperate with a corresponding hook and loop fastener 28 (FIG. 4) found on the underside of the base portion 30 of child seat S.

Figure 4:
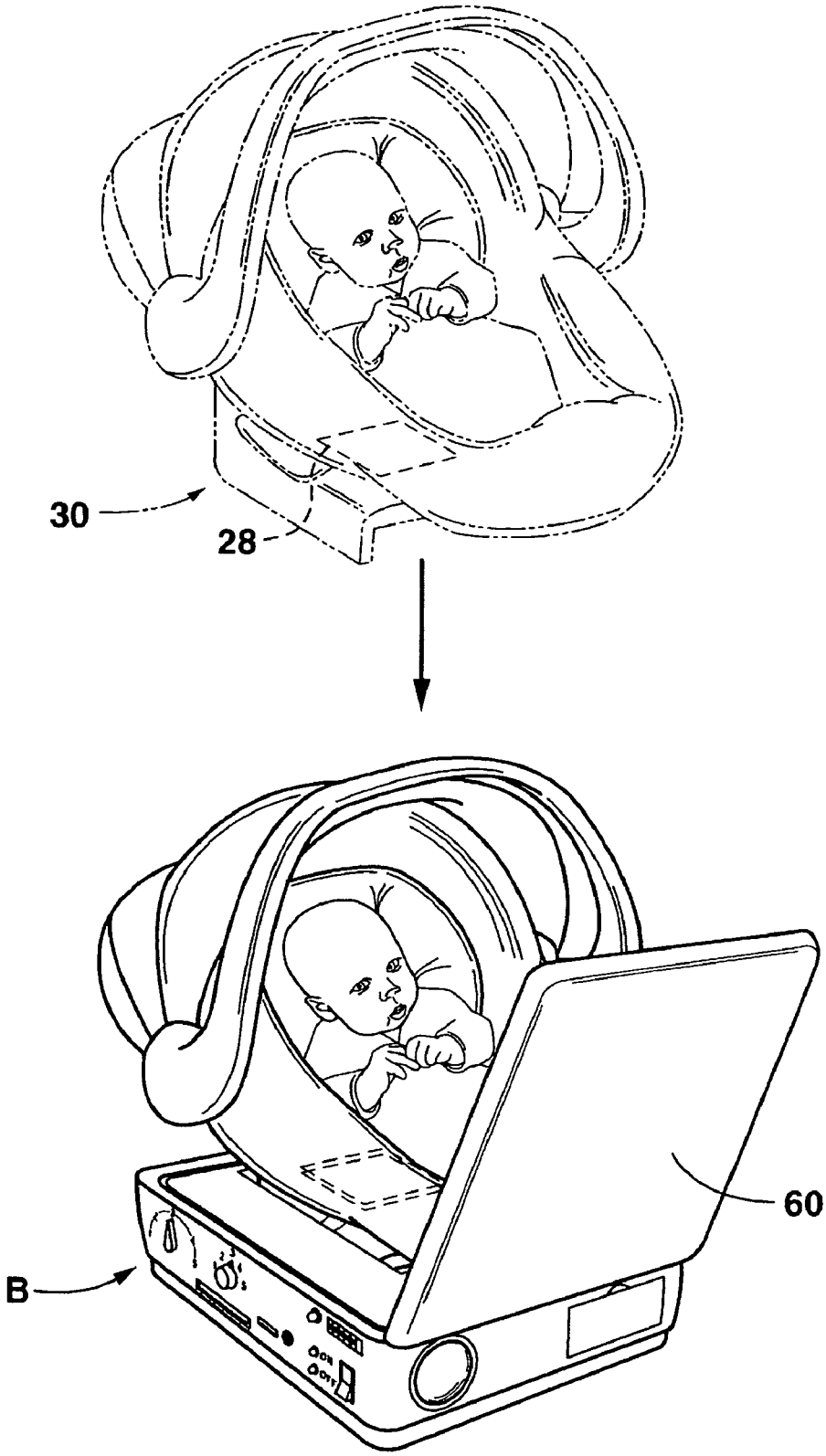
FIG. 4 is a perspective view of the base unit illustrated in FIGS. 1 and 2 receiving the child seat illustrated in FIG. 3.

It is to be noted here that child seat S, having a seat base SB (FIG. 3), is shown for illustrative purposes only, and child seat simulation system 10 of the present invention can be used with a variety of other child seat styles and configurations. Additionally, base unit B could have a dedicated child seat provided thereon, which could take the form generally as illustrated in FIG. 4, if desired.

Although hook and loop fasteners have been illustrated herein as a releasable fastener means, it is to be understood that such fastener means could include clips, straps, screws, locks, snaps, cords, belts, bands, brackets, or the like (none shown), could be used instead of or in combination with fastener members 26, 28 to releasably attach seat S to support P.

Figure 7:
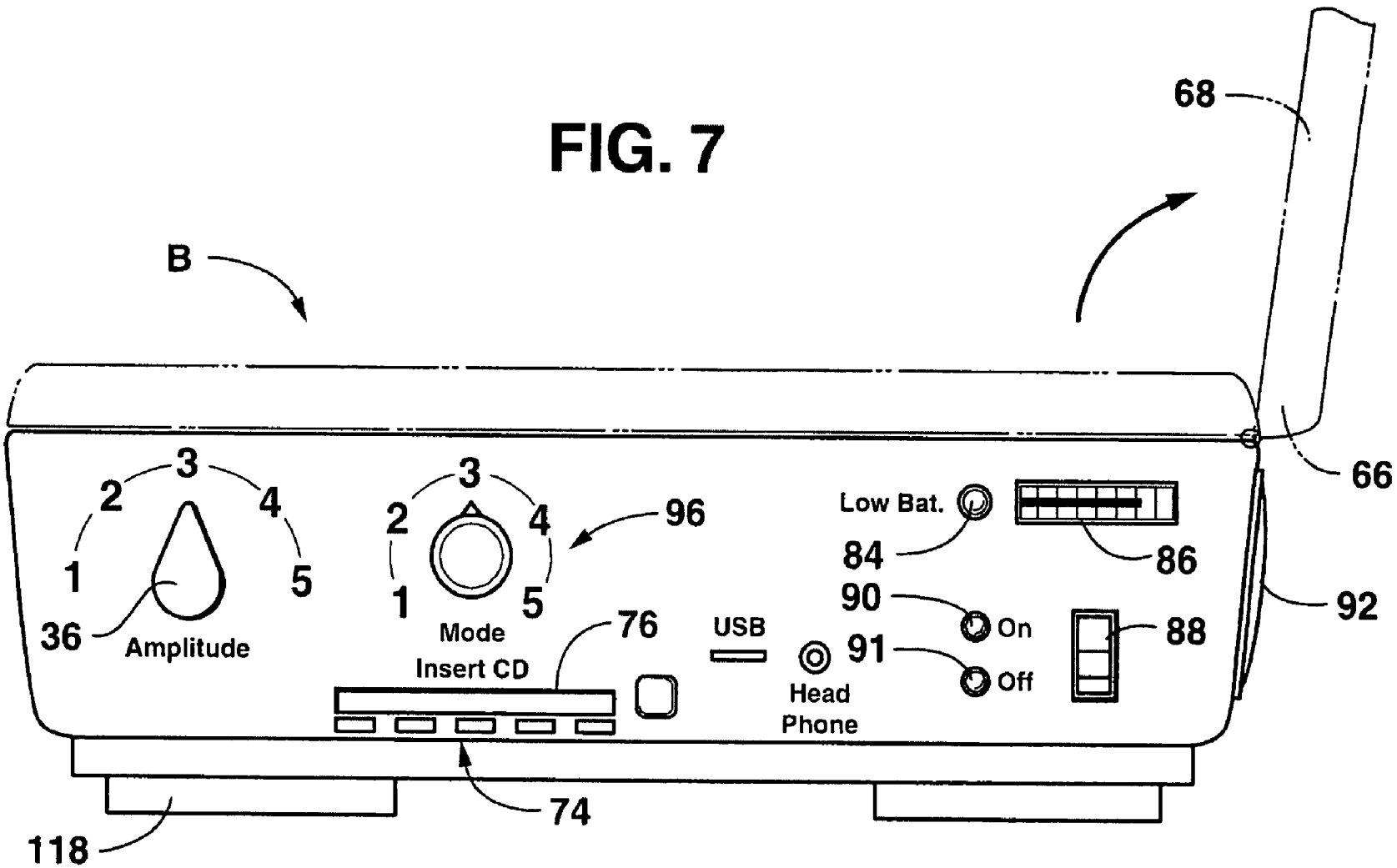
FIG. 7 is a front elevational view of the base unit illustrated in FIG. 1.

Base unit B includes an adjustment control, generally 34, for adjusting operation of actuator A. As shown in more detail in FIG. 7, adjustment control 34 could comprise a selector knob 36 for use in adjusting the amplitude, or range of motion, provided by actuator A to support P. Adjustment control 34 also serves as an adjustment for the desired motion to be imparted to support P, depending on the child carried in seat S. By varying the amplitude of support P, the operation of base unit B can be changed dependent upon the age, weight and/or preferences of the child.

Base unit B could include a weight sensing device, generally 38, (FIG. 12) having a potentiometer connected to support P for automatically determining the weight of the child in seat S (when the child and the seat are placed on support P). Through a predetermined algorithm in processor D, the appropriate amplitude of oscillation and/or displacement of support P by actuator A can be determined.

A recorder 40 (FIG. 12) can be used for recording, through use of an accelerometer, a voice coil actuator, electro-dynamic sensor, or other suitable motion detector sensor, the motions generally experienced by the child seat when carried in a vehicle. Recorder 40 could, for example, be placed on the seat 42 (FIG. 3) of a vehicle where child seat S is normally carried, and the vehicle then driven through a predetermined route and/or at will. The motions of the vehicle would be recorded by the motion sensing portion of recorder 40. Additionally, recorder 40 includes a microphone or other sound sensing device for recording the ambient surroundings in the vehicle as it is driven. Both the recorded motion signals and the sound signals can be captured and stored on an electronic media storage device, which could include, but is not limited to, a tape, a compact disc (CD), MP3 player, MP4 player, a digital video disc (DVD), an electrically-erasable programmable read-only memory (EEPROM) device, a computer drive, a non-volatile read write memory (NVRWM) device, a memory card, a USB flash drive, etc.

Recorder 40 preferably has a play-back function wherein it can be used as an output device for outputting the motion signal and sound signal, each of which is preferably synchronized to one another to add further reality to the simulation experienced by the child when seat S is connected to base unit B and actuator A energized. Additionally, a camera 50 (FIG. 12) can be used to record visual images from the child's point of view when the child is in child seat S as the vehicle is driven. The output from camera 50 could be stored on tape and/or separately in electronic storage media of the camera, or, alternately, could be fed to the recorder 40 and stored simultaneously, and in synchronization with the motion and sound signals recorded thereon.

Recorder 40 and/or camera 50 can, as external signals, provide output of such motion, sound, and video signals to base unit B via a USB port 52 and/or other input, such as a headphone, or coaxial input 54. Additionally, such motion, sound, and video signals can be external signals downloaded and/or streamed from the internet, or some other computer and/or computer network, to processor D in base unit B via USB port 52, if desired.

Alternately, instead of using a separate recorder 40, base unit B itself could function as a sensing unit. For example, if actuator A is an voice coil actuator 58, such sensor may provide a mechanical output upon receiving current, or, may act in reverse to output a motion signal if subjected to changes in motion. In other words, voice coil actuator 58 (FIGS. 5 and 6) could be used to sense motions in the vehicle upon base unit B being provided in such vehicle. Base unit B could thus perform the recording function of recording the motions experienced by the child. Similarly, an acoustic emission device capable of outputting in the audible range, such as a speaker 60, could also act in reverse fashion to function as a microphone to record the ambient sounds of the vehicle in synchronization with the motions sensed and outputted by voice coil actuator 58. Processor D could include its own electronic storage, such as a hard drive, non-volatile read write memory, flash memory, an EEPROM memory, etc. Alternately, an additional microphone (not shown) could be provided in base unit B, if desired, to record the ambient sounds in the vehicle.

For video inputs, camera 50 could be plugged into USB port 52 and/or input 54 to simultaneously record video images as the vehicle is driven, with such camera output being recorded by processor D, preferably, in synchronization with the motion signals and audio signals inputs discussed above.

Figure 11:
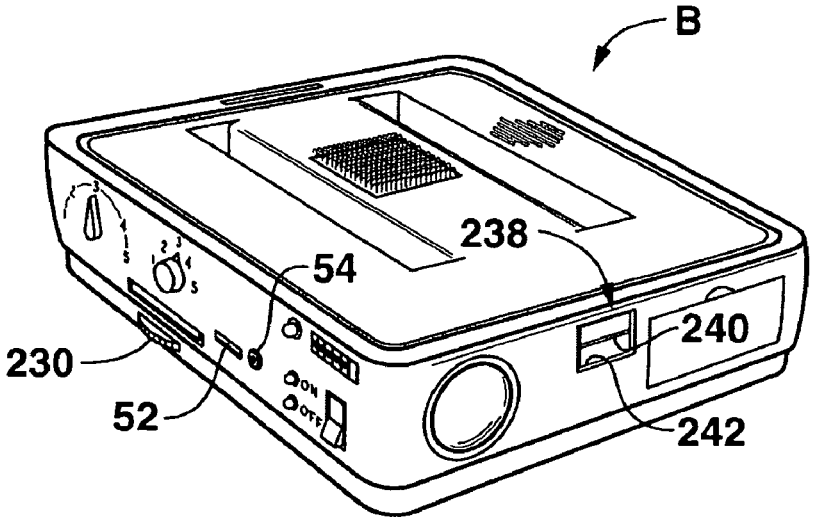
FIG. 11 is a perspective view of the base unit illustrated in FIGS. 1 and 2 without the cover and/or display portion illustrated in FIG. 2.

Base unit B includes a cover, generally 66, which may include a display, generally 68, having a display screen such as a liquid crystal display (LCD), plasma display, projection display, with an image projector being carried within base 10 (not shown), or a cathode ray tube display. Cover 66 is hinged to base B with hinges 70, and is shown in an upright position in FIGS. 2, 4 and 7. FIG. 11 shows base unit B without such cover 66. Display 68 could be operated by controls, generally 74. A CD and/or DVD player 76, having controls, generally 78, is provided for receipt of CDs and/or DVDs, and player 76 can be used to play CDs and/or DVDs recorded by recorder 40 or pre-recorded by other means, or other audio CDs or DVDs.

Display 68 can also be used to view movies, television shows, and other video recordings. Player 76 may further include a recording function, such that in the event base unit B is used to record motion and sound signals, as discussed above, a CD or DVD disc can be used in player 76 as storage media for storing the signals developed by base unit B when used as a recorder.

Base unit B may also include a direct current (DC) battery, or battery pack, generally 80, for powering actuator A, processor D, player 76, etc. Battery 80 is preferably rechargeable through use of an alternating current (AC) charger (not shown). Alternately, base unit B could be provided with AC power directly, with such AC power being converted to direct current power using an inverter system (not shown). Base unit B includes a low battery indicator light 84, for indicating when battery 80 has an output that falls below a certain voltage level, and also a display 86, such as light emitting diodes (LED), liquid crystal display, etc., for displaying the status of base unit B and the operation of the components thereof, such as processor D, actuator A, player 76, etc.

A power switch 88 is provided as are power "on" and "off" indicators 90, 91, respectively, which could be LED and/or incandescent lamps.

A foot switch 92 can also be provided on base unit B for allowing the power to base unit B to be readily switched on, and, more importantly, quickly switched off by the operator using his or her foot. Since base unit B is preferably placed on the floor, foot switch 92 is convenient in that it allows operation of base unit B without requiring the operator to bend or stoop over.

In addition to, or instead of, providing actual recordings made from a vehicle through use of recorder 40 and/or base B as a recording unit, player 76 could be used to receive prerecorded CDs, DVDs, USB memory devices, internet downloads, etc., representing alternate simulation experiences. For example, a DVD could be provided giving a simulated ride through "Paris, France," through riding along a winding country road, through riding in a vehicle through an animal safari park, etc., if desired. Such prerecorded programs could be resident within an electronic storage portion (hard drive, stored memory or other memory devices as discussed above) of processor D, and such could be selected using the mode control 96 on base unit B. Such prerecorded programs or sequences of base unit B can be imparted to actuator A in the form of synthesized signals which can be one or a combination of one or more signals such as, but not limited to, a single frequency sine wave signal, a multiple sine wave signal, a random noise signal, a periodic non-sinusoidal wave signal, etc. Signals could be provided directly from processor D to actuator A, or could be provided from an external source through USB port 52, input 54, etc.

A remote control 98 can be provided for remote operation of base unit B. For example, in use, base B and child seat S, together with the child in child seat S, could be placed in a family room of the home, with base B placed on a program of predetermined length, or playing back a recorded simulation. During this time, actuator A moves support P upwardly and downwardly simulating to the child the recorded ride. A feedback loop and sensor 99 can be provided for actuator A, if desired for additional control of actuator A. Sensor could monitor actuator A to ensure actuator A operates properly, providing the correct amplitudes of movement of support P, and also as a safety device to ensure actuator A only operates within predetermined limits of amplitude, frequency, etc.

At the end of such recording, actuator A would ordinarily stop. Remote control 98 could be used to restart the recording, switch to another recording, vary the amplitude, sound level of speaker 60, turn the display 66 on and off, etc. Remote control 98 could be radio frequency operated, infrared operated, or both, and can include a display window 100 for displaying the mode of its operation.

Figure 5:
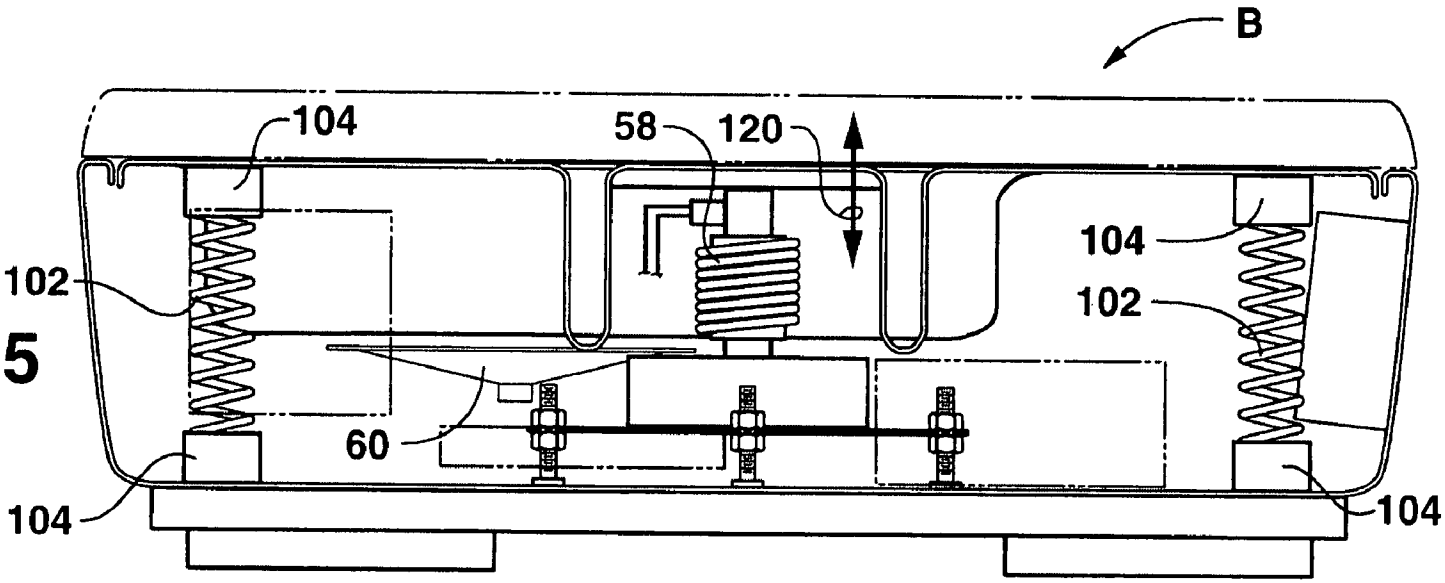
FIG. 5 is a sectional view taken along lines 5-5 of FIG. 1.
Figure 6:
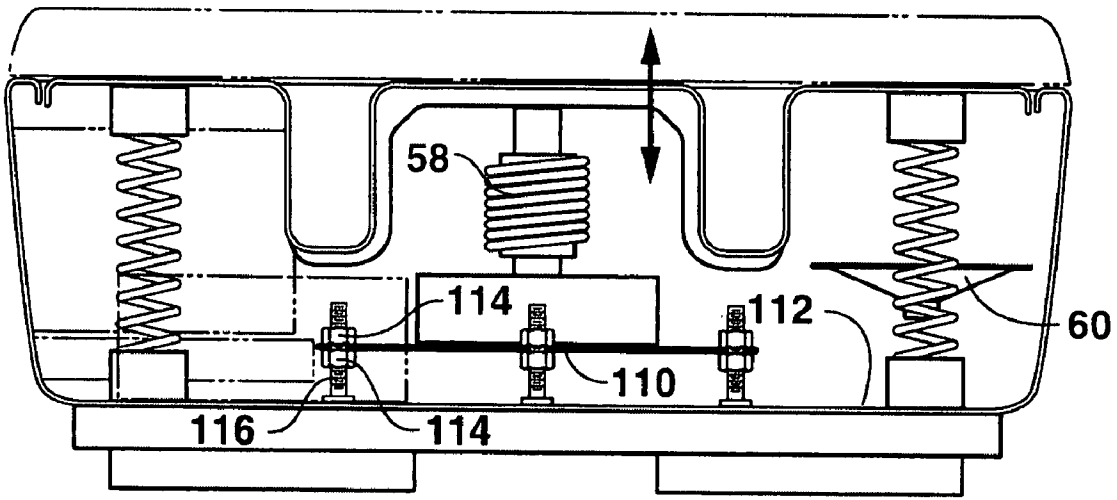
FIG. 6 is a sectional view taken along lines 6-6 of FIG. 1.

Turning to FIGS. 5 and 6, sectional views of base unit B is shown, with support P being mounted on coil springs 102 carried within receivers 104. Voice coil actuator 58 is mounted on an actuator support 110, such support 110 being suspended above the floor 112 of base unit B with nuts 114 threaded on threaded studs 116. The height of support 110 can be adjusted through rotation of nuts 114 on studs 116. Feet 118 positioned on the bottom of base unit B are preferably cushioned, such as rubber, foam, neoprene, or some other suitable material, in order to dampen or reduce transmission of vibration of base unit B to the surface on which it is supported, which is preferably a floor. Movement of support P upwardly and downwardly is in the direction of arrow 120, as voice coil actuator 58 operates.

Figure 8:
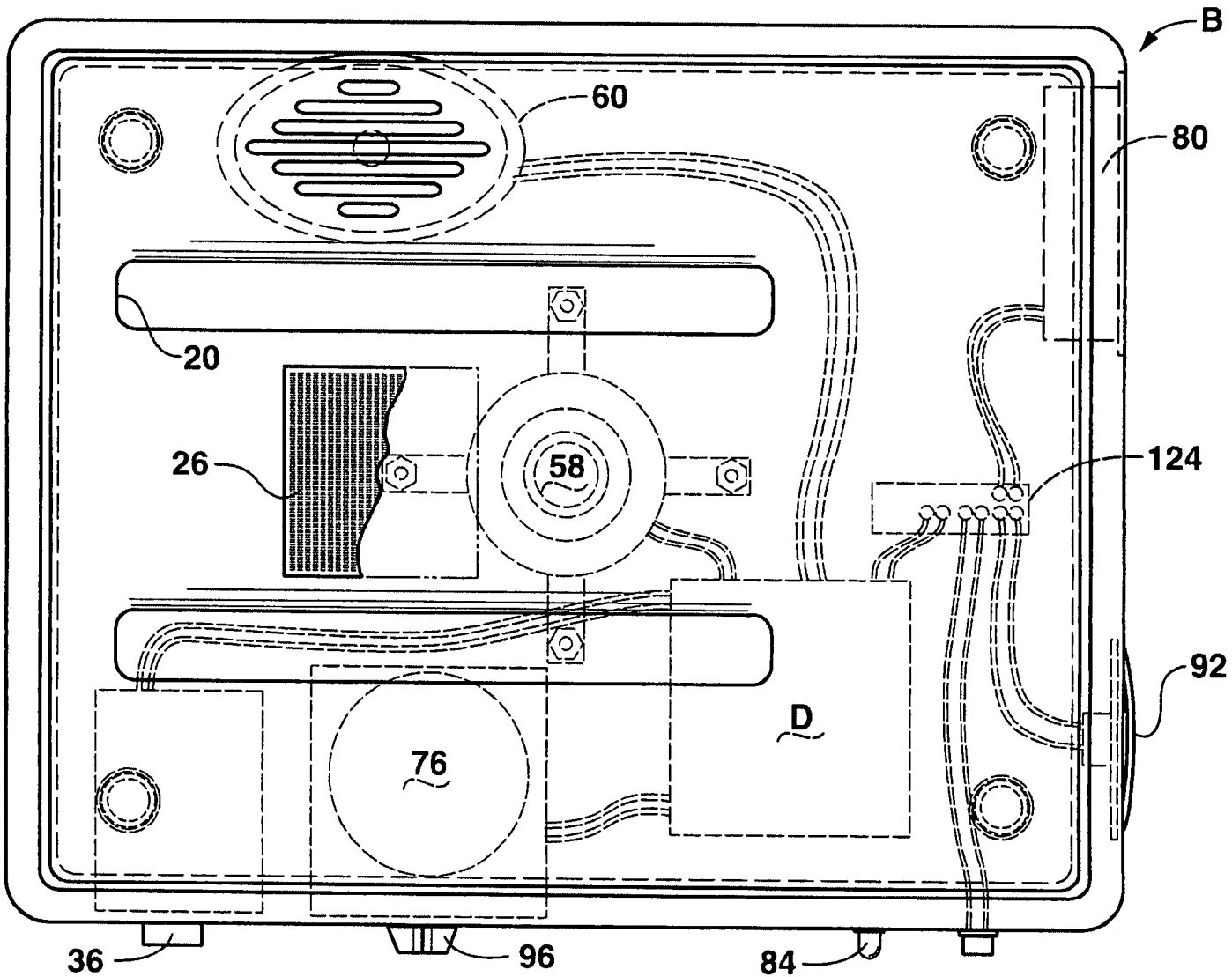
FIG. 8 is a plan view of the base unit illustrated in FIG. 1, with parts cut away.

FIG. 8 illustrates a plan view of base unit B and includes the interconnection of speaker 60, player 76, controller D, battery 80, power switch 88 and foot switch 92. A terminal block 124 is provided for distribution of power from battery 80.

An automatic shut-off switch (not shown) may be provided which senses the presence of child seat S and which automatically shuts base unit B down in the event child seat S becomes disengaged with base unit B. Additionally, a level switch, such as a mercury switch (not shown), may be included in base unit B, and shuts base unit B down in the event base unit B becomes inclined during operation at an undesirable inclination.

Figure 9A:
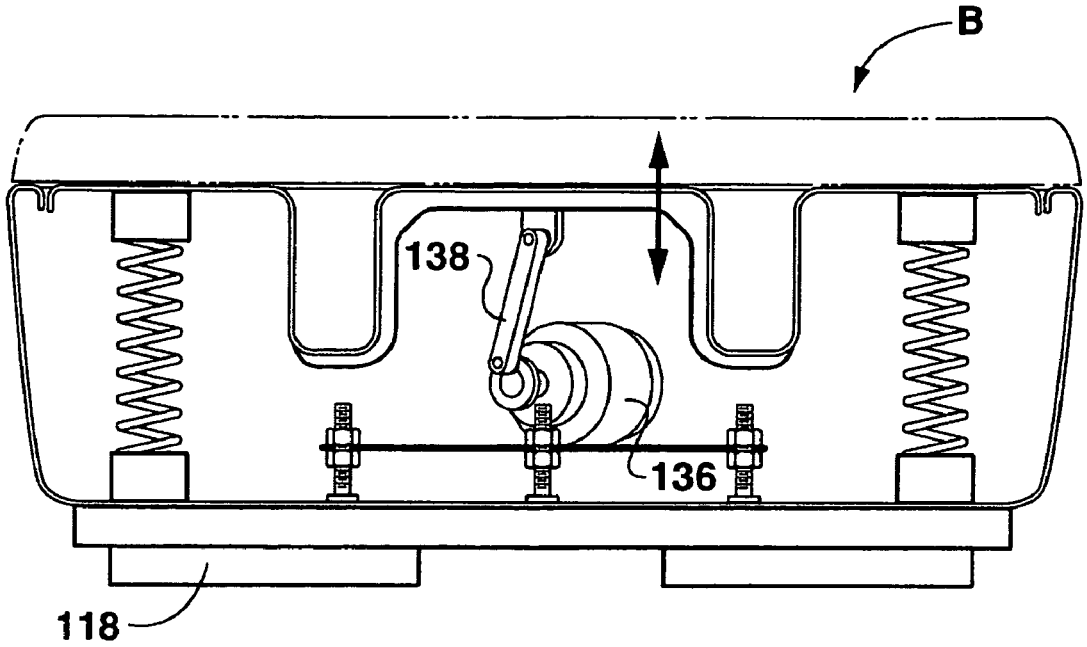
FIG. 9A is a sectional view of a first alternate embodiment base unit constructed in accordance with the child seat simulation system of the present invention.

Turning to FIG. 9A, actuator A is shown in an alternate embodiment as being an electric motor 136. Motor 136 could be a rotating motor with a crank arm arrangement, generally 138, connected to support P, or could be a stepping motor, server motor, or the like, if desired.

Figure 9B:
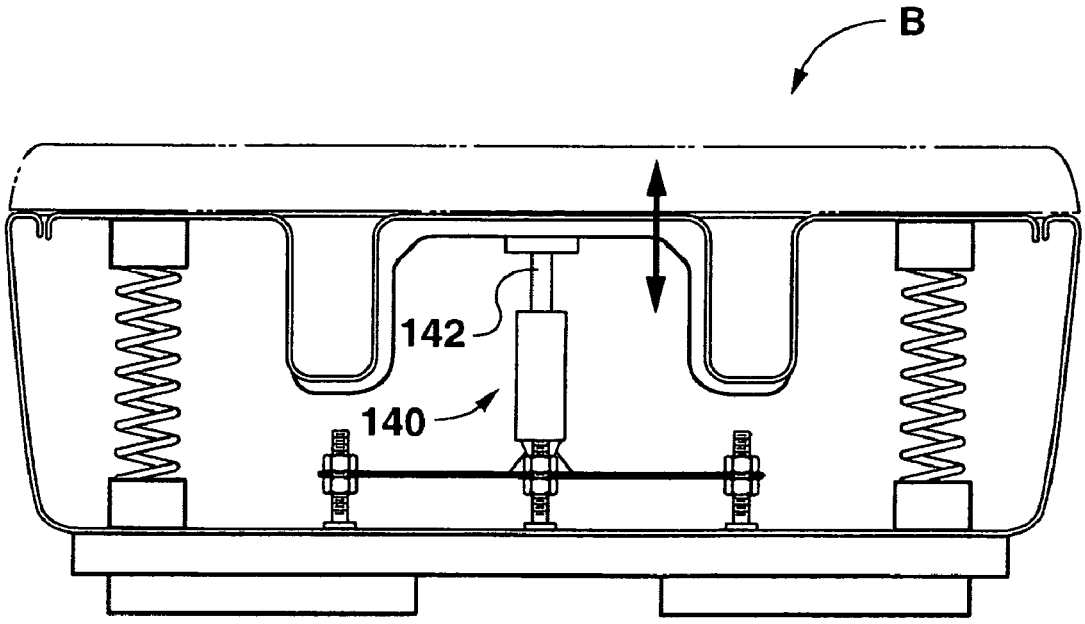
FIG. 9B is a sectional view of a second alternate embodiment base unit constructed in accordance with the child seat simulation system of the present invention.

FIG. 9B illustrates a second alternate embodiment of actuator A with such actuator being a pressurizable cylinder/piston device, generally 140, having a piston/rod 142 extending outwardly therefrom and connected to support P. Cylinder/piston device 140 is preferably of a double action arrangement and could also be electro-magnetically activated and/or could be a double action solenoid.

Figure 10:
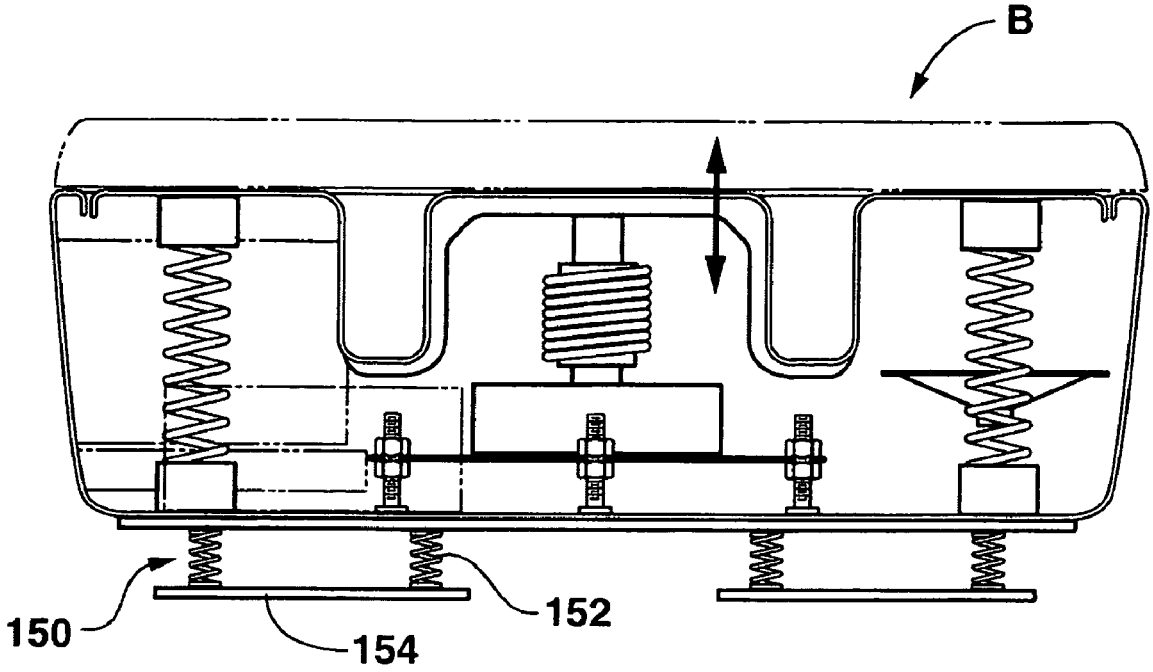
FIG. 10 is a sectional view of a third alternate embodiment base unit constructed in accordance with the child seat simulation system of the present invention.

FIG. 10 illustrates a further embodiment of the present invention, wherein cushion pads 118 are replaced by spring pads 150 having coil springs 152 positioned between the bottom of base unit B and feet 154. The alternate embodiment of such spring support may serve to further limit transfer of vibration from base unit B to the surface on which unit B is supported.

Figure 13:
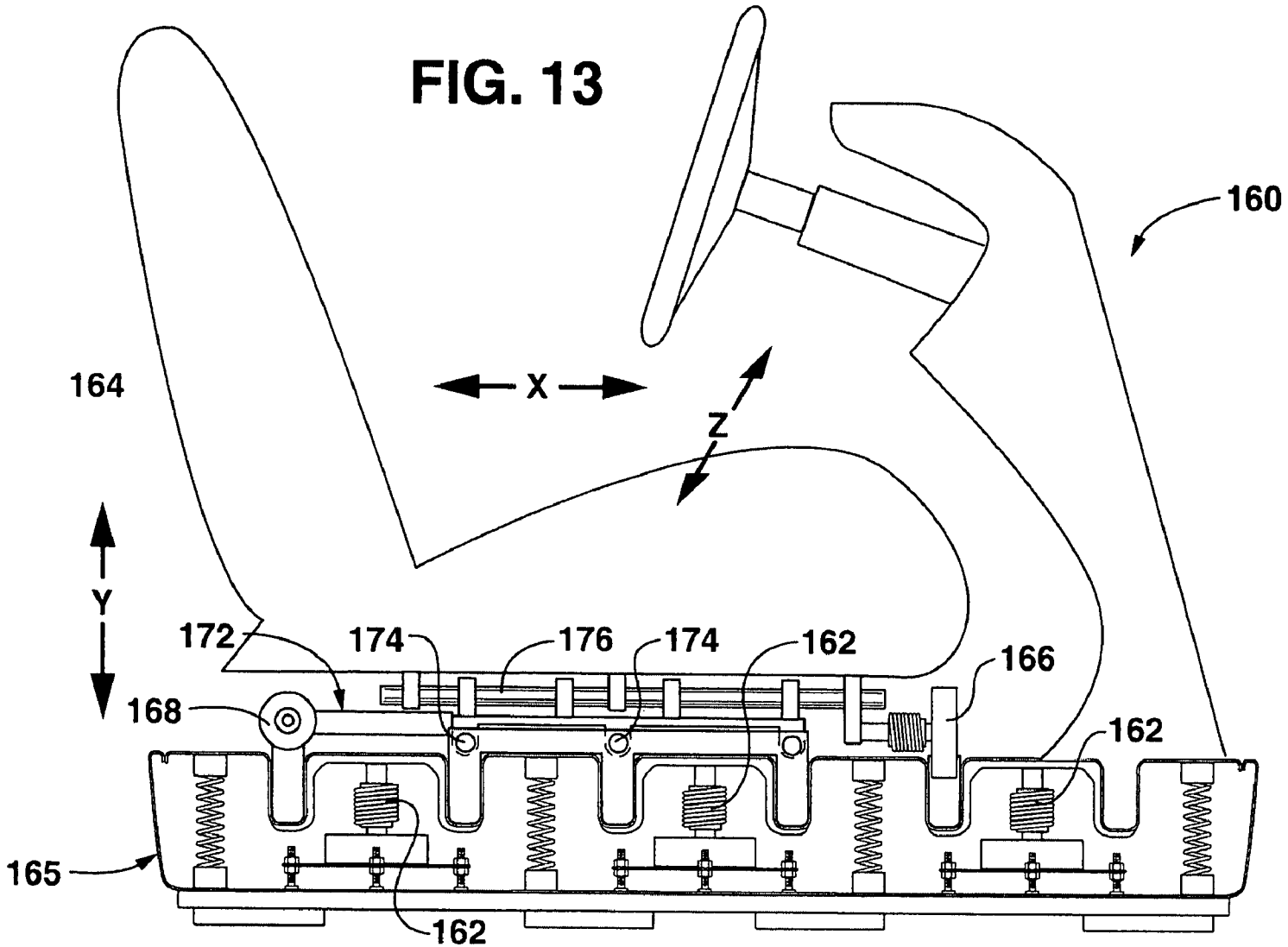
FIG. 13 is a sectional view of a fourth alternate embodiment of a child seat simulation system constructed in accordance with the present invention, illustrating a vehicle seat which may be used in vehicle driving scenarios, such as in driver training, in connection with video games, etc.

FIG. 13 illustrates another alternate embodiment of the present invention, and discloses a seat arrangement system, generally 160, which can be used in driver training, in playing video games, etc. in which the driver would be subjected to a simulated driving experience. In one preferred embodiment, a display screen (not shown) would be visible to the driver to further enhance the driving simulation. System 160 could be used in a video game context, particularly for video games involving driving, flying, underwater activities, space-based activities, etc.

System 160 includes actuators 162 for moving seat 164 and base, generally 165, in a direction shown by arrow Y, a second actuator 166 for moving seat 164 in a direction as shown by arrow X, and a third actuator 168 for moving seat 164 in a direction along arrow Z. A table 172 is mounted on rails 174, which allow lateral movement of seat 164 along a Z axis, and seat 164 is mounted on rails 176 which allows movement of seat 164 along an X axis. Movement of seat 164 in each of those three perpendicular directions or axes is caused by the corresponding X, Y and Z actuators. Similarly, as noted above with respect to base unit B, the actuators are driven in a manner to simulate to the person sitting on seat 164 a ride and environment, involving motion, sound, and visual images which had been earlier recorded. Child seat S could, if desired, be mounted on table 172 to provide seat S with motion about three axes.

Figure 14:
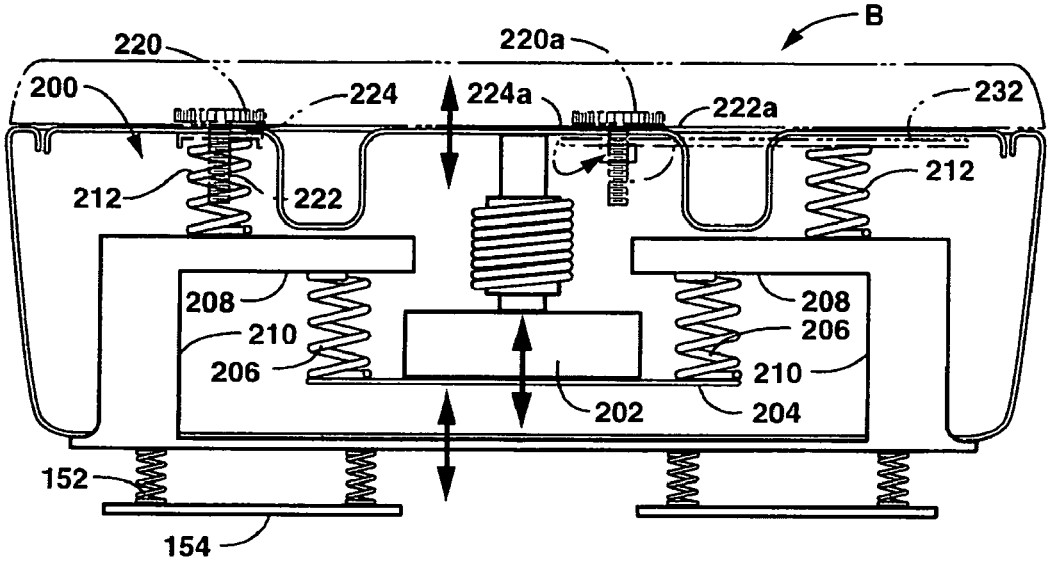
FIG. 14 is a sectional view of a fifth alternate embodiment of child seat simulation system constructed in accordance with the present invention, having a dynamic balancing system.

As shown in FIG. 14, a dynamic balancing system, generally 200, can be provided to base unit B to reduce the transfer of vibration to the supporting surface of base B. In one preferred embodiment, a dynamically-tuned mass 202 provides a reaction force corresponding to the operation of actuator A, which, together with a damper/dashpot (not shown), generally nulls vibration being transport to the supporting surface of base unit B. Mass 202 is supported on a shelf 204 suspended by springs 206 from arms 208 of support towers 210. Child seat support P is also supported by support towers 210 via springs 212.

Voice coil actuator 58 includes a coil of wire 216 which, during operation, produces an electromagnet which generates varying magnetic fields with corresponding attractive and repulsive forces with respect to mass 202 and support P (and child seat S thereon). By virtue of the suspension of the base 218 (carried on shelf 204) of voice coil actuator 58, the attraction/repulsion of coil of wire 216 within the magnetic field preferably causes generally equal an opposite displacement of mass 202 (and base 218) and support P (with child seat S thereon) with respect to one another and with respect to towers 210. The polarity of the signal received by voice coil actuator 58 determines whether attraction or repulsion forces are applied, i.e., whether mass 202 is either attracted to or repelled from support P.

Springs 206 and 212 provide an at-rest, equilibrium position of mass 202 with respect to support P. Preferably, the mass of mass 202 and the mass of support P are equalized by adjusting springs 210 and/or springs 212 to compensate for the weight of the child seat and the child to be placed in child seat S. In one preferred embodiment, the compression of one or more springs 212 can be adjusted with an adjustment knob 220, which is connected to a threaded rod 222. Rod 222 is threadingly received in a threaded bore 224 or captive nut (not shown) in support P. The upper end of spring 212 is received by a cup 226, and threaded rod 222 is passed through spring 212.

Upon tightening of knob 220, spring 212 is compressed by an amount sufficient to equalize the masses of mass 202/base 218 and support P/child seat S. An adjustment knob 220, rod 222, and cup 226 could be provided for each spring 212, if desired. Alternately, a separate plate, or tray, 232 (only a portion of which is shown in FIG. 14) could be provided which contacts the top of each of the springs 212 (taking the place of cup 226) which allows simultaneous adjustment of springs 212 using a single adjustment knob 220*a* and threaded rod 222*a* carried in a threaded bore 224*a* of support P.

Although not shown, damping means such as rubber, foam rubber, shock absorbers, etc. could be attached between support P and towers 210 to dampen any undesirable oscillations and/or vibrations.

Figure 15:
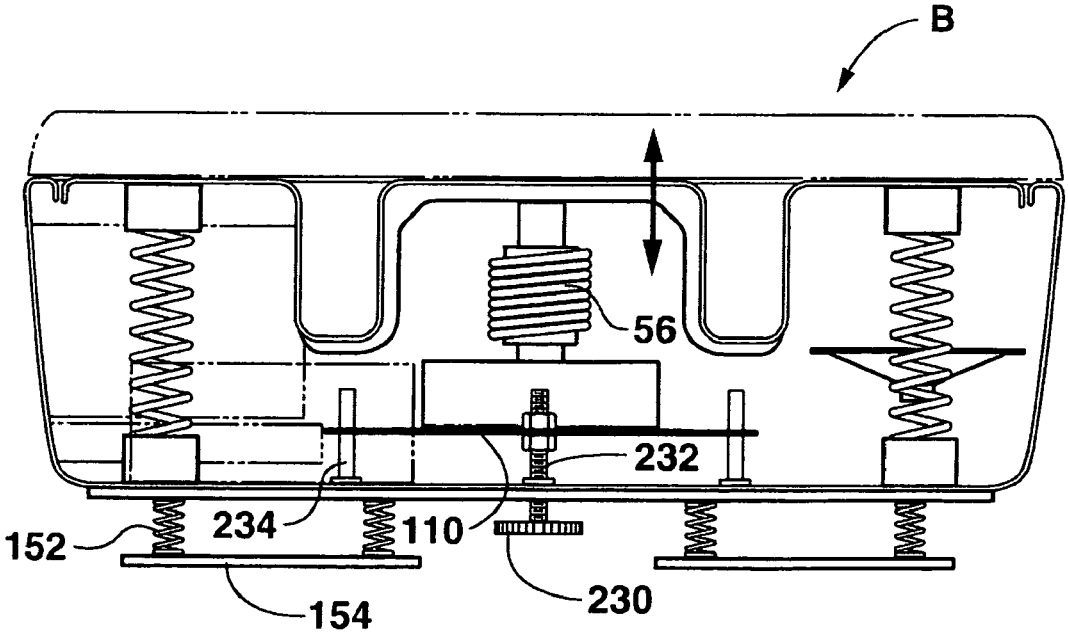
FIG. 15 is a sectional view of a sixth alternate embodiment of child seat simulation system constructed in accordance with the present invention, having a weight adjusting system for allowing adjustment dependent on the weight of a child and/or the child seat.

FIG. 15 illustrates in more detail an alternate embodiment of the present invention having a manual adjustment configuration for adjusting system 10 dependent on the weight of the child carried in child seat S. It is preferable to position support at the proper elevation in order to permit support P to experience a full range of motion and/or travel during operation. If support P is too high or too low, once the child and child seat are in place on support P, the child may not gain advantage of the full motion simulation experience. In this embodiment, an adjustment knob 230 has a threaded shaft 232 which is threadingly connected to actuator support 110 such that the elevation of support 110 can be varied by rotating knob 230 in a selected direction. For example, rotation of knob 230 in a first direction may raise support 110, while rotation of knob 230 in the other direction lowers support 110. Support 110 rides about guide rods 234 as its height is adjusted via knob 230.

While knob 230 is shown in FIG. 15 as being on the bottom of base unit B, as shown in FIG. 11, knob 230 could also be accessible from the side of base unit B, if desired. Also, a height indicator, generally 238 (FIG. 11), can be provided in base unit B to indicate both the recommended, or desired, height and the actual height of support P in order to aid in the proper setting of the height of support P using knob 230. Height indicator 238 may include a pointer 240 attached to support P and visible through a slot or window 242.

In accordance with the foregoing, the method of the present invention, in one preferred embodiment, includes providing, remotely from a vehicle, a support, such as support P, for a child seat S. The method also includes producing a motion signal, such as signal D1, substantially corresponding to the motions experienced by the child in the child seat when in a vehicle. Furthermore, the method includes moving the support responsive to the motion signal for simulating the motions experienced by the child in the child seat when transported by the vehicle, or, if desired, other motions not corresponding to a ride in the vehicle.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A system for simulating the sounds and motions experienced by a child in a child seat in a vehicle traveling on a road, the system comprising:

a support that supports the child seat;

a first recorder configured to be transported by the vehicle that records motions generally experienced by the child in the child seat as the vehicle travels on the road;

at least one controller in communication with said first recorder that outputs a motion signal substantially corresponding to said motions recorded by said first recorder;

an actuator in communication with said support and said at least one controller that moves said support responsive to said motion signal;

a second recorder configured to be transported by the vehicle that records sounds generally experienced by the child in the child seat generally synchronously with said first recorder recording said motions generally experienced by the child in the child seat as the vehicle travels on the road;

said at least one controller being in communication with said second recorder and configured to output a sound signal substantially corresponding to said sounds recorded by said second recorder; and an acoustic emission device connected to said at least one controller that outputs an audible signal responsive to said sound signal generally synchronously with said movement of said actuator responsive to said motion signal.

2. The system as defined in claim 1, further comprising:

a third recorder for making a recording of images generally experienced by the child in the child seat as the vehicle travels on the road; and a display that outputs a visual image correlating to said recording of said images.

3. The system as defined in claim 1, further comprising:

said actuator being configured to move said support in at least three axes, each of said axes being generally perpendicular with respect to one another.

4. The system as defined in claim 1, further comprising:

means for dynamically balancing said actuator.

5. The system as defined in claim 1, further comprising:

a dynamically tuned mass that provides a reaction force corresponding to operation of said actuator.

6. The system as defined in claim 1, further comprising:

means for manually adjusting said actuator dependent on a weight of the child carried in the child seat.

7. The system as defined in claim 1, further comprising:

means for automatically adjusting said actuator dependent on a weight of the child carried in the child seat.

8. The system as defined in claim 1, further comprising:

a wireless remote control for controlling said actuator.

9. The system as defined in claim 1, further comprising:

said at least one controller including a processor; and a signal input to said processor for receipt of an external signal.

10. The system as defined in claim 1, further comprising:

said actuator being a voice coil.

11. A system for use in connection with a child seat for simulating motions and sounds experienced by a child in the child seat in a vehicle traveling on a road, the child seat having downwardly extending flanges, the system comprising:

a base;

a support connected to said base that supports the child seat;

said support defining at least one recess that receives the downwardly extending flanges of the child seat;

said base being configured to be transported by the vehicle;

a first recorder connected to said base that records motions generally experienced by the child in the child seat as the vehicle travels on the road;

at least one controller in communication with said first recorder that outputs a motion signal substantially corresponding to said motions recorded by said first recorder;

an actuator connected to said support and in communication with said at least one controller that moves said support responsive to said motion signal;

an adjuster connected to said base that allows manual adjustment of said movement of said actuator dependent on a weight of the child carried in the child seat;

said actuator being configured to move said support in at least three axes, each of said axes being generally perpendicular with respect to one another;

means for selecting a predetermined sequence of operation of said actuator;

means for dynamically balancing said actuator;

a second recorder connected to said base that records sounds generally experienced by the child in the child seat generally synchronously with said first recorder recording said motions generally experienced by the child in the child seat as the vehicle travels on the road;

at least one storage device in communication with said first recorder and said second recorder that stores said motions recorded by said first recorder and said sounds recorded by said second recorder;

said at least one controller being in communication with said second recorder and configured to output a sound signal substantially corresponding to said sounds recorded by said second recorder;

a processor in communication with said controller that synchronizes said sound signal with said motion signal;

a signal input to said processor for receiving an external signal; and an acoustic emission device connected to said at least one controller that outputs an audible signal responsive to said sound signal generally synchronously with said actuator moving said support responsive to said motion signal, to thereby simulate the sounds and motions experienced by the child in the vehicle upon the child being in the child seat and the child seat being supported by said support.

12. A system for simulating the sounds and motions experienced by a child in a child seat in a vehicle traveling on a road, the system comprising:

a base;

a support connected to said base that supports the child seat;

said base being configured to be transported by the vehicle;

a voice coil actuator connected to said base that senses motions generally experienced by the child in the child seat as the vehicle travels on the road;

a first recorder in communication with said voice coil actuator that records said motions sensed by said voice coil actuator;

at least one controller in communication with said first recorder that outputs a motion signal substantially corresponding to said motions sensed by said voice coil actuator;

said voice coil actuator being configured to move said support responsive to said motion signal;

a speaker connected to said base that senses sounds generally experienced by the child in the child seat generally synchronously with said voice coil actuator sensing motions generally experienced by the child in the child seat as the vehicle travels on the road;

a second recorder in communication with said speaker that records said sounds sensed by said speaker;

said at least one controller being in communication with said second recorder and configured to output a sound signal substantially corresponding to said sounds sensed by said speaker;

a processor in communication with said controller that synchronizes said sound signal with said motion signal; and said speaker being configured to output an audible signal responsive to said sound signal generally synchronously with said voice coil actuator moving said support responsive to said motion signal, to thereby simulate the sounds and motions experienced by the child in the vehicle upon the child being in the child seat and the child seat being supported by said support.

* * * * *